US008526848B2

(12) United States Patent
Nishiuwatoko et al.

(10) Patent No.: US 8,526,848 B2
(45) Date of Patent: Sep. 3, 2013

(54) ELECTROPHOTOGRAPHIC IMAGE FORMING APPARATUS

(75) Inventors: Tsutomu Nishiuwatoko, Numazu (JP); Ken Kikuchi, Nishima (JP); Takashi Akutsu, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 311 days.

(21) Appl. No.: 12/964,878

(22) Filed: Dec. 10, 2010

(65) Prior Publication Data

US 2011/0305479 A1 Dec. 15, 2011

(30) Foreign Application Priority Data

Dec. 11, 2009 (JP) ..... 2009-281426
Nov. 12, 2010 (JP) ..... 2010-253575

(51) Int. Cl.
*G03G 15/00* (2006.01)

(52) U.S. Cl.
USPC ..... 399/110; 399/121

(58) Field of Classification Search
USPC ..... 399/121, 308, 312, 317, 110
See application file for complete search history.

(56) References Cited

U.S. PATENT DOCUMENTS 6,141,513 A 10/2000 Nishiuwatoko et al.
7,463,847 B2 12/2008 Sato
8,254,809 B2 8/2012 Nishiuwatoko
2005/0214036 A1* 9/2005 Embry et al. ..... 399/302
2006/0140674 A1 6/2006 Sato
2007/0160380 A1* 7/2007 Imaizumi et al. ..... 399/90
2010/0239308 A1 9/2010 Kikuchi et al.
2010/0239311 A1 9/2010 Kikuchi et al.
2010/0239312 A1 9/2010 Kikuchi et al.
2010/0247138 A1 9/2010 Kikuchi et al.
2010/0247140 A1 9/2010 Kikuchi et al.
2012/0003005 A1 1/2012 Nishiuwatoko

FOREIGN PATENT DOCUMENTS

JP 2000-19928 A 1/2000
JP 2006-184553 A 7/2006

OTHER PUBLICATIONS

Notification of Reasons for Refusal dated Jul. 24, 2012, in Japanese Application No. 2010-253575.

* cited by examiner

*Primary Examiner* — Walter L Lindsay, Jr.
*Assistant Examiner* — Barnabas Fekete
(74) *Attorney, Agent, or Firm* — Fitzpatrick, Cella, Harper & Scinto

(57) ABSTRACT

An electrophotographic image forming apparatus includes an opening provided in a main assembly of the apparatus; an openable member for closing and opening the openable member; a drawer member for supporting an electrophotographic photosensitive drum, the drawer member being movable between an inside position inside the main assembly and an outside position outside the main assembly where the cartridge can be mounted and dismounted; a transfer unit disposed above the drawer member and being movable between a contact position in contact with the drum and a separation position separated from the drum in a state that the drawer member is in the inside position; and an interrelating member interrelating the openable member and the transfer unit with each other.

22 Claims, 8 Drawing Sheets

(a)

(b)

ELECTROPHOTOGRAPHIC IMAGE FORMING APPARATUS

FIELD OF THE INVENTION AND RELATED ART

The present invention relates to an electrophotographic image forming apparatus which forms an image on recording medium with the use of one or more process cartridges mounted removably in the main assembly of the apparatus.

In this specification, an "electrophotographic image forming apparatus" means an apparatus which forms an image on recording medium with the use of an electrophotographic image formation process. Its examples include an electrophotographic copying machine, an electrophotographic printer (laser beam printer, LED printer, etc.), a facsimile apparatus, a word processor etc. "Recording medium" means medium on which an image can be formed with the use of an electrophotographic image forming apparatus. It includes ordinary paper, OHP sheet, etc.

Further, a "cartridge" means a process cartridge or a development cartridge. That is, it means a cartridge which contributes to a process for forming an image on recording medium by being removably mounted in the main assembly of an electrophotographic image forming apparatus. More specifically, it means a process cartridge which is removably mountable in the main assembly of an electrophotographic image forming apparatus. It comprises: an electrophotographic photosensitive member; at least one processing means among a charging means, a developing means, a cleaning means; and a cartridge in which the electrophotographic photosensitive member and processing means are integrally placed. In other words, a process cartridge includes a cartridge in which an electrophotographic photosensitive member is integrally placed along with at least one among a charging means, a developing means, or a cleaning means so that they can be removably mountable in the main assembly of an image forming apparatus. Incidentally, a process cartridge which has an electrophotographic photosensitive member and a developing means is referred to as a process cartridge of the integration type. Further, a process cartridge which has an electrophotographic photosensitive member and one or more processing means other than a developing means is referred to as a process cartridge of the separation type.

A process cartridge is removably mountable in the main assembly of an image forming apparatus by a user himself or herself. Thus, a process cartridge makes it easier to maintain an image forming apparatus. Incidentally, processing means are means for processing an electrophotographic photosensitive member.

Further, a development cartridge, which is a developing means, has a development roller. The development cartridge contains developer (toner) to be used by the development roller to develop an electrostatic latent image on an electrophotographic photosensitive member. It also is removably mountable in the main assembly of an electrophotographic image forming apparatus. In the case of an electrophotographic image forming apparatus which uses a development cartridge, its electrophotographic photosensitive member is a part of the main assembly of the image forming apparatus, or a part of a process cartridge of the so-called separation type (which does not have developing means). A development cartridge also can be removably mountable in the main assembly of an electrophotographic image forming apparatus by a user himself or herself. Thus, it also makes it easier to maintain an electrophotographic image forming apparatus.

That is, a "cartridge" includes both a process cartridge of the so-called integration type and a process cartridge of the so-called separation type. It also includes a process cartridge which is employed in combination with a process cartridge of the so-called separation type by an electrophotographic image forming apparatus. Further, it includes a development cartridge which is removably mountable in the main assembly of an image forming apparatus whose electrophotographic photosensitive member is an integral part of the main assembly, to process the electrophotographic photosensitive member. The present invention relates to an electrophotographic image forming apparatus which forms images on recording medium, and in the main assembly of which cartridges are removably mountable.

As one of the methods (systems) for replacing a cartridge in the main assembly of an electrophotographic image forming apparatus, the one disclosed in Japanese Laid-open Patent Application 2006-184553 has been known. According to this patent document, a development cartridge is supported by a development cartridge drawer (tray), and the cartridge is replaced after the drawer is pulled out by a preset distance from the main assembly of the image forming apparatus in the frontward direction. The cartridge drawer is supported by a pair of drawer guiding members which are attached to the front door of the apparatus main assembly so that when the door is in its closed position, the drawer guiding members hold the cartridge drawer in the preset position in the apparatus main assembly, whereas as the door is opened, the movement of the door moves the drawer guiding members into their turn-out position. That is, the problem that when the cartridge drawer is moved into its cartridge mounting-and-dismounting position, a development cartridge comes into contact and/or interferes with a charging apparatus, etc., is prevented by structuring an image forming apparatus in such a manner that the cartridge drawer has to be roughly horizontally moved into its cartridge mounting-and-dismounting position after the pair of drawer guiding members are moved into their turn-out position.

According to the prior art described above, in order to prevent the problem that as the cartridge drawer is pulled out of the apparatus main assembly, the cartridge in the cartridge drawer comes into contact with, interferes with, and/or rubs against the mechanical components, mechanical apparatuses, etc., of the apparatus main assembly, the apparatus main assembly is structured so that the cartridge drawer has to be moved into its turn-out position before it can be pulled out of the apparatus main assembly. That is, the apparatus main assembly is structured so that the cartridge drawer, which is relatively heavy because of the weight of the cartridge(s) it is holding, is vertically moved. Thus, the prior art described above is desired to be improved in terms of the operational efficiency of an image forming apparatus. Accordingly, the present invention is one of the further developments of the prior art.

SUMMARY OF THE INVENTION

Thus, the primary object of the present invention is to provide an electrophotographic image forming apparatus characterized in that when its cartridge drawer is moved, the cartridge drawer and/or the cartridges in the cartridge drawer do not come into contact with, interfere with, and/or rub the components, mechanism, etc. of the apparatus main assembly, and that it is substantially better in terms of the operability of the cartridge drawer than any of the electrophotographic image forming apparatuses in accordance with the prior arts, which is similar in structure to the electrophotographic image forming apparatus in accordance with the present invention. Another object of the present invention is to provide an electrophotographic image forming apparatus which is simpler in structure and less in weight than any of the electrophotographic image forming apparatuses in accordance with the prior arts which are similar in structure to the electrophotographic image forming apparatus in accordance with the present invention.

According to an aspect of the present invention, there is provided an electrophotographic image forming apparatus for forming an image on a recording material, comprising an opening provided in a main assembly of the apparatus of the electrophotographic image forming apparatus; an openable member movable between a close position for closing said opening and an open position for opening said opening; a drawer member for supporting an electrophotographic photosensitive member, said drawer member being movable in a direction crossing with a longitudinal direction of the electrophotographic photosensitive member through said opening between an inside position inside the main assembly of the apparatus and an outside position outside said main assembly of the apparatus where said cartridge can be mounted and dismounted; a transfer unit movable about a rotation axis disposed downstream of said electrophotographic photosensitive member with respect to a mounting direction of said drawer member from the outside position to the inside position, between a contacting position contacting said electrophotographic photosensitive member and a spaced position spacing from said electrophotographic photosensitive member in a state that said drawer member is in the inside position; and an interrelating member interrelating said openable member and said transfer unit with each other, wherein said interrelating member moves said transfer unit from the contacting position to the spaced position with movement of said openable member from the close position to the open position, and moves said transfer unit from the spaced position to the contacting position with movement of said openable member from the open position to the close position.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

[Embodiment 1]

(General Structure of Electrophotographic Image Forming Apparatus)

Figure 1A:
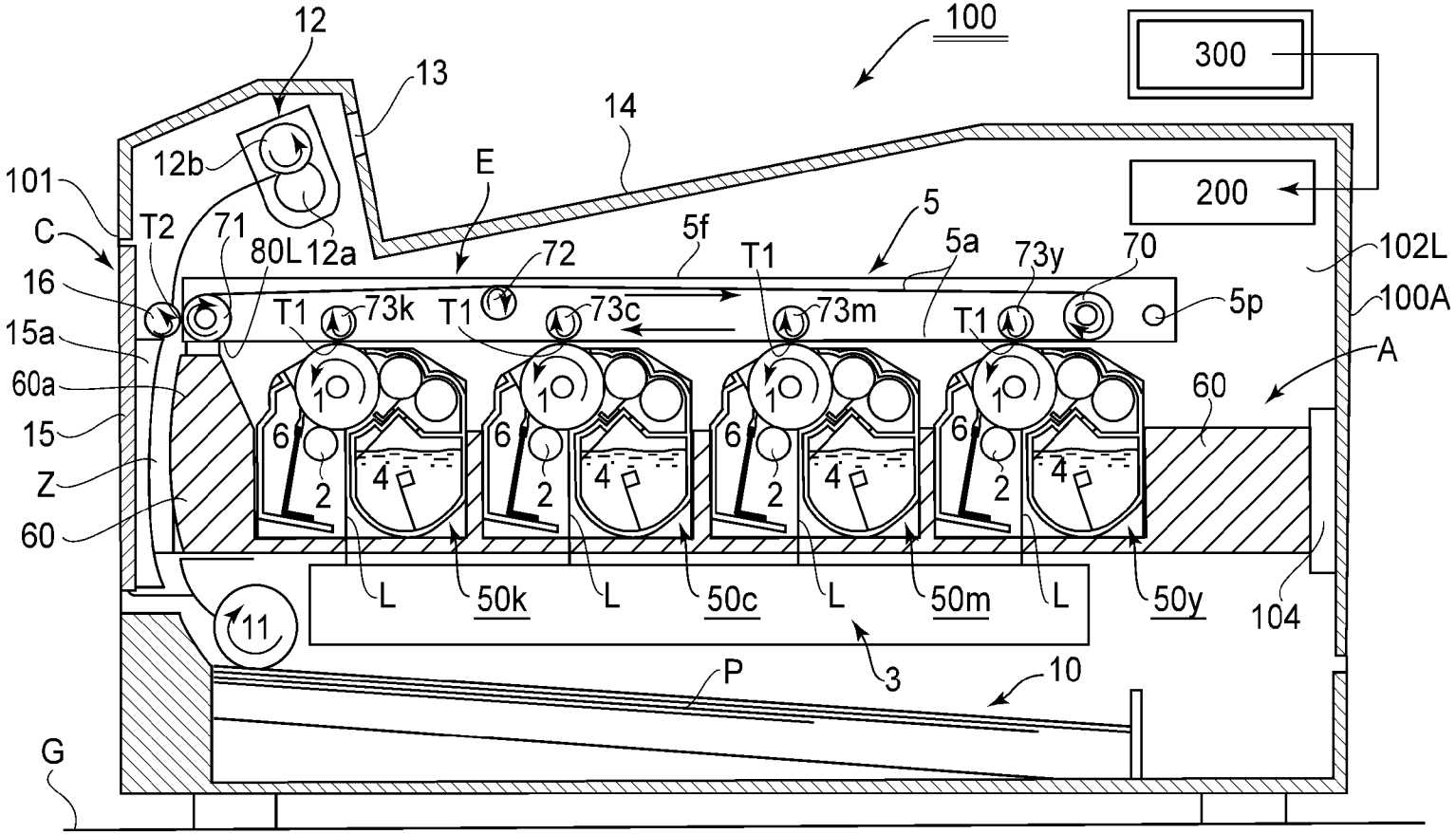
FIGS. 1A and 1B are vertical sectional views of the electrophotographic image forming apparatus in the first preferred embodiment of the present invention, as seen from the right side of the apparatus when the door of the main assembly of the image forming apparatus is in its closed position.
Figure 1B:
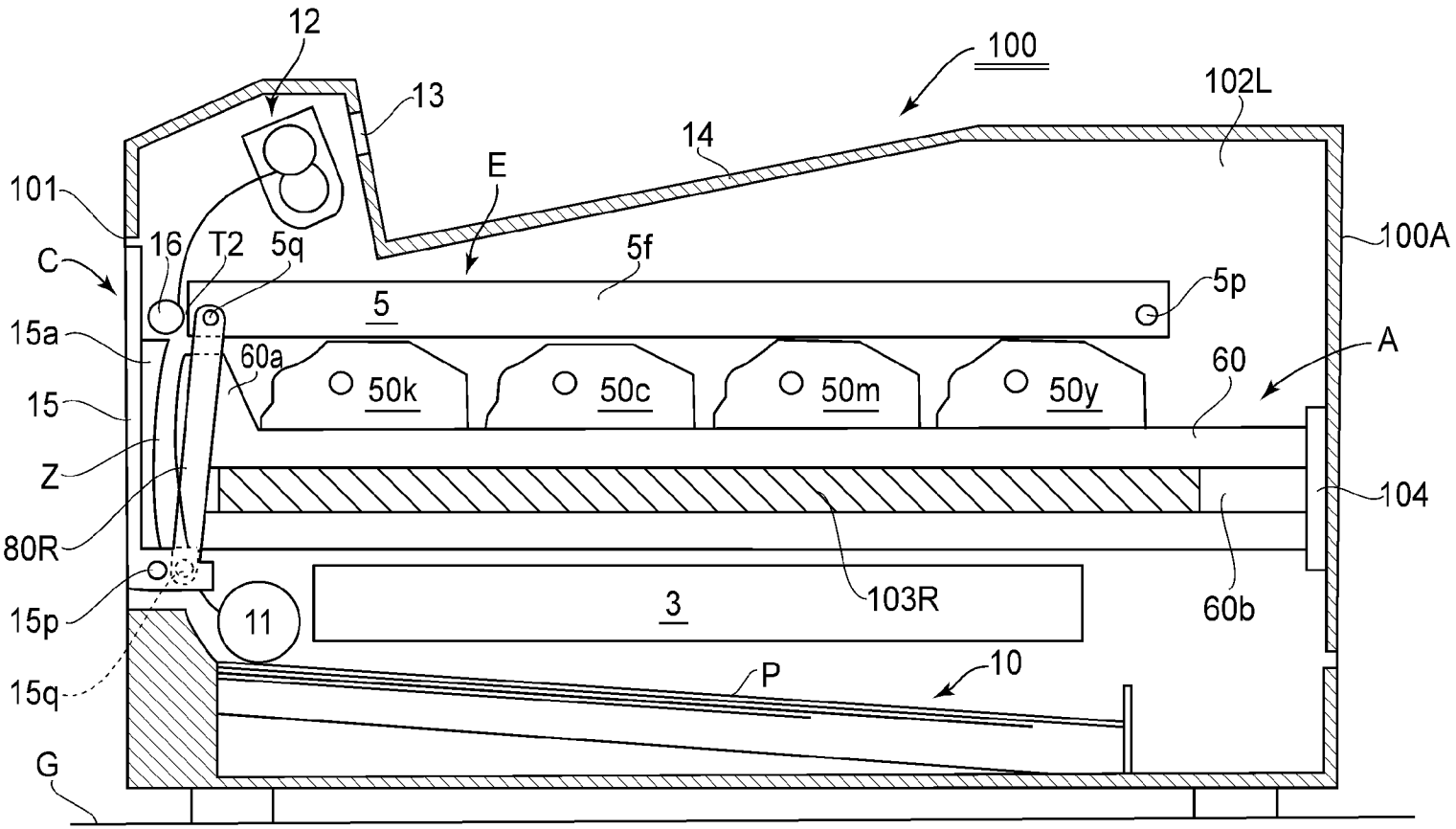

FIG. 1A is a vertical sectional view of the electrophotographic image forming apparatus 100 in this embodiment, as seen from the right-hand side of the apparatus, and FIG. 1B is a vertical sectional view of the same apparatus as the one in FIG. 1A, at a sectional plane different from the one for FIG. 1A, as seen from the right-hand side of the apparatus. This apparatus 100 is a laser beam printer based on four primary colors. It employs multiple (four) process cartridges 50 (50*y*, 50*m*, 50*c* and 50*k*) which are removably mountable in the main assembly 100A of the apparatus 100. It can form full-color images on a sheet P of recording medium with the use of an electrophotographic process. That is, it is an electrophotographic color image forming apparatus which can form full-color or monochromatic images on the sheet P of recording medium, based on the information (which is in the form of electrical signals) of an image to be formed, which is inputted into the control circuit portion 200 of the apparatus main assembly 100A from an external host apparatus 300, such as a personal computer, an image reader, a facsimile, and the like. The surface G of a printer table, a desk, a floor, etc., on which the apparatus 100 is placed is roughly horizontal.

In the following descriptions of the preferred embodiments of the present invention, the "front" side of the apparatus 100 means the side where the door 15 (cartridge replacement door) is present. The "rear" side of the apparatus 100 means the opposite side of the apparatus 100 from the "front" side. The "frontward" direction means the rear-to-front direction, and the "rearward" direction means the opposite direction from the "frontward" direction. The "left and right" sides of the apparatus 100 mean the left and right sides of the apparatus 100 as seen from the "front" side of the apparatus 100. The "left and right" mean the left and right, respectively, as seen from the "front" side of the apparatus 100. The "upward and downward" directions of the apparatus 100 are the upward and downward directions, respectively, with reference to the direction of gravity. Further, the apparatus main assembly 100A (which may be referred to simply as "main assembly A") means the entirety of the image forming apparatus minus the cartridges 50.

Figure 2:
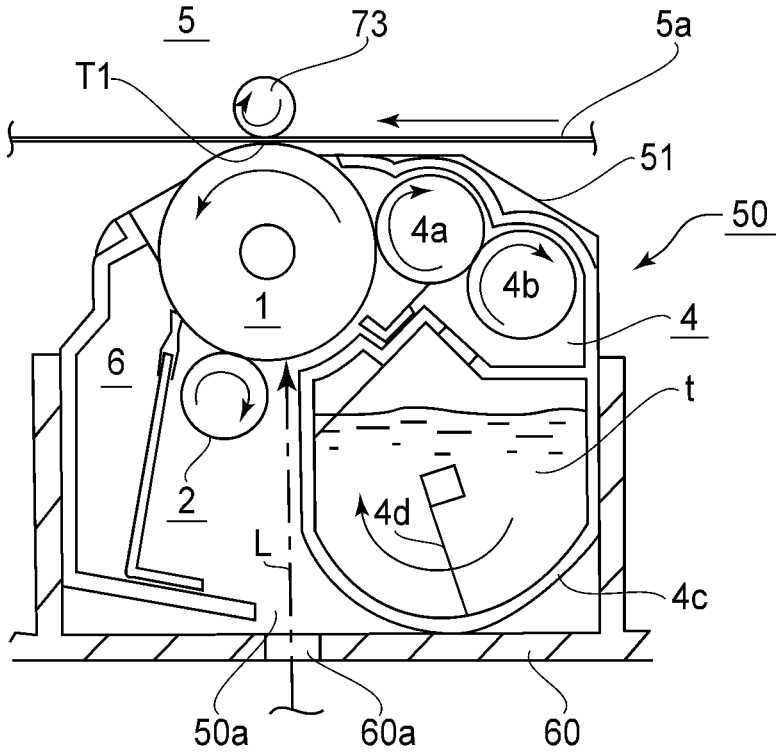
FIG. 2(*a*) is an enlarged sectional view of one of the cartridges in FIG. 1A, and FIG. 2(*b*) is an enlarged side view of one of the cartridges in FIG. 1A.
Figure 2:
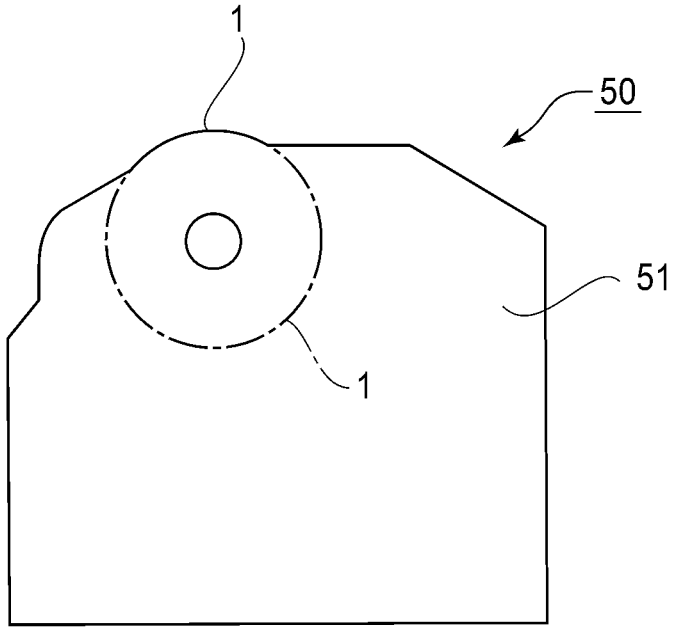

After the proper installation of four cartridges 50, that is, the first to fourth cartridges 50(50*y*, 50*m*, 50*c*, and 50*k*) in the main assembly 100A of the image forming apparatus 100, the first to fourth cartridges 50 are roughly horizontal, and are in alignment in parallel in the left-to-right direction. That is, the apparatus 100 is of the so-called inline or tandem type; it has multiple (four) image formation stations, which are for forming multicolor or full-color images with the use of electrophotographic technologies and are roughly in an sequential alignment. In this embodiment, the cartridges 50 are of the so-called integration type. They are the same in structure, and are different only in the color of the developer (toner) therein. FIG. 2(*a*) is an enlarged view of one of the cartridges 50 in FIG. 1A. FIG. 2(*b*) is a right side view of the cartridge 50. Each cartridge 50 has: an electrophotographic photosensitive drum 1 (which hereafter may be referred to simply as drum 1) which is rotatable image bearing member; and three means for processing the drum 1, that is, a charging means 2, a developing means 4, and a cleaning apparatus 6. These components of the cartridge 50 are attached to the cartridge frame 51. They are integral with each other, and are preset in positional relationship among them, and also, relative to the cartridge frame 51.

The charging apparatus 2 is a means for uniformly charging the peripheral surface of the drum 1 to preset polarity and potential level. The charging apparatus 2 in this embodiment is in the form of a roller (charge roller). The developing apparatus 4 is a developing means for developing the latent image on the drum 1 with the use of developer t (toner). The developing apparatus 4 in this embodiment has: a development roller 4*a*; a development roller coating roller 4*b* which coats (supplies) the development roller 4*a* with the developer t; a developer container 4*c* in which the developer t is stored; a rotational developer stirring member 4*d*; etc. The development roller 4*a* is the developer bearing member for supplying the drum 1 with the developer t. The developer container 4*c* is the developer storing portion in which the developer t, which is to be used for developing the latent image, is stored. The cleaning apparatus 6 is a cleaning means for removing the developer remaining on the peripheral surface of the drum 1 after the transfer (first transfer) of the toner image from the drum 1. The cleaning apparatus 6 in this embodiment is in the form of a blade. Stored in the first cartridge, that is, cartridge 50*y*, is the developer t of yellow (y) color. Stored in the second cartridge, that is, cartridge 50*m*, is the developer t of magenta (m) color. Stored in the third cartridge, that is, cartridge 50*c*, is the developer t of cyan (c) color. Stored in the fourth cartridge, that is, the cartridge 50*k*, is the developer t of black (k) color.

The apparatus main assembly 100A is provided with a laser scanner unit 3 as a drum exposing apparatus, which is under the space for the group of the cartridges 50 in the apparatus main assembly 100A. The unit 3 scans (exposes) the downwardly facing portion of the peripheral surface of the drum 1 in each cartridge 50, with a beam L of laser light (exposure beam). More specifically, the cartridges 50 are held by a cartridge drawer 60 of the apparatus main assembly 100A. The bottom plate of the cartridge drawer 60 has four holes 60*a* (windows), which correspond one for one to the four cartridges 50 in the cartridge drawer 60. The beam L of laser light outputted upward from the unit 3 enters the corresponding cartridge 50 through the corresponding hole 60*a* (window) mentioned above, and the opening 50*a* of the bottom wall of the cartridge 50, and reaches the downwardly facing portion of the peripheral surface of the drum 1 through the gap between the charging apparatus 2 and developing apparatus 4, forming thereby an electrostatic latent image line by line on the portion of the peripheral surface of the drum 1, which has just been charged by the charge roller 2. Then, the electrostatic latent image on the peripheral surface of the drum 1 is developed by the developing apparatus 4, into a visible image, that is, an image formed of developer (toner); a visible image is formed of the developer on the peripheral surface of the drum 1.

The apparatus main assembly 100A is provided with a transfer unit 5, which is in the top portion of the main assembly 100A and is above the space for the cartridges 50 (50*y*, 50*m*, 50*c* and 50*k*). The unit 5 has a frame 5*f*, belt suspending first and second rollers 70 and 71, a tension roller 72, and four (first to fourth) first transfer rollers 73 (73*y*, 73*m*, 73*c* and 73*k*). The frame 5*f* is rectangular, and its lengthwise direction is parallel to the front-to-rear direction of the main assembly 100A. The first and second belt suspending rollers 70 and 71 are rotatable, and are in the rear and front portions of the frame 5*f*, being parallel to each other. Their axial lines are parallel to the left-to-right direction of the apparatus main assembly 100A. The tension roller 72 and the first to fourth first transfer rollers 73 are between the two rollers 70 and 71. The unit 5 has also an intermediary transfer belt 5*a* (endless belt), which is dielectric and flexible. The belt 5*a* is stretched around the above-mentioned rollers 70, 71, 72 and 73, being thereby kept stretched. The intermediary transfer belt 5*a* is in contact with the upwardly facing portion of the peripheral surface of the drum 1 in each cartridge 50, by its downwardly facing portion of outward surface in terms of the loop which the belt 5*a* forms. Each roller 73 remains pressed against the top portion of the peripheral surface of the corresponding drum 1 with the presence of the belt 5*a* between the roller 73 and drum 1. The area of contact between the drum 1 of each cartridge and the belt 5*a* is the first transfer nip T1. The roller 71 is kept pressed upon a second transfer roller 16 with the presence of the belt 5*a* between the two rollers 71 and 16. The area of contact between the roller 16 and belt 5*a* is the second transfer nip T2.

The frame 5*f* of the unit 5 is supported by the apparatus main assembly 100A at its rear end in such a manner that it is rotatable about a shaft 5*p* by which the frame 5*f* is rotationally supported. That is, the frame 5*f* (unit 5) is rotationally movable about the frame supporting shaft 5*p* so that the front end of the frame 5*f* moves upward or downward. The transfer unit supporting shaft 5*p*, about which the transfer unit 5 is rotationally movable, is positioned so that when the cartridge drawer 60 is holding the four cartridges 50 and is in its image formation position, the shaft 5*p* will be on the downstream side of the drum 1 of the most downstream cartridge 50, that is, the cartridge 50*y*, in the cartridge drawer 60, in terms of the direction (indicated by arrow mark IN in FIGS. 4A and 4B) in which the cartridge drawer 60 is moved into the apparatus main assembly 100A. Thus, the unit 5 is rotationally movable about the transfer unit supporting shaft 5*p* in such a manner that its front end moves upward or downward. When the door 15 is in its closed position C, the unit 5 is in its contact position E, in which it is in contact with the cartridges 50, as will be described later. The contact position E of the unit 5 is the position in which the unit 5 keeps the belt 5*a* is in contact with the drums 1. When the door 15 is in its open position D (FIG. 3A), the unit 5 is in its separation position F in which it remains separated from the cartridge 50. The separative position F of the unit 5 is the position in which the unit 5 keeps the belt 5*a* separated from the drums 1. Thus, by rotationally moving the unit 5 about its transfer unit supporting shaft 5*p*, it is possible to prevent any of the cartridge 50 in the cartridge drawer 60 from coming into contact with the intermediary transfer belt 5*a* when the drawer 60 is moved back into the apparatus main assembly 100A. In other words, this structural arrangement can minimize the space necessary to move the transfer unit 5 to move the cartridge drawer 60 relative to the apparatus main assembly 100A, making it therefore possible to provide an image forming apparatus which is smaller in size than any of the image forming apparatuses in accordance with the prior arts.

Further, the apparatus main assembly 100A has a fixing apparatus 12, which is in the front side of the top portion of the apparatus main assembly 100A. It has also a delivery tray 14, which is a part of the top wall of the apparatus main assembly 100A. The fixing apparatus 12 in this embodiment has a fixation film unit 12*a* and a pressure roller 12*b*. Further, the apparatus main assembly 100A has a sheet feeder cassette 10, which is below the unit 3. The sheet feeder cassette 10 stores multiple sheets P of recording medium (which hereafter may be referred to simply as recording sheets P) in layers.

The operation carried out by this image forming apparatus to form a full-color image is as follows. The drum 1 in each of the cartridge 50 begins to be rotated at a preset speed in the counterclockwise direction indicated by an arrow mark, in response to an image formation start signal. At the same time, the development roller 4*a*, development roller coating roller 4*b*, etc., of each developing apparatus 4 begin to be rotated at preset speeds, respectively, in the direction indicated by arrow marks. Further, the belt 5*a* begins to be circularly moved by the roller 71 (as belt driving roller) at a preset speed which corresponds to that of the drum 1, in the clockwise direction (which is the same as that of drum 1) indicated by an arrow mark. Further, the unit 3 also begins to be driven. Then, the roller 2 uniformly charges the peripheral surface of the drum 1 to preset polarity and potential level in each cartridge 50. The unit 3 scans (exposes) the uniformly charged portion of the peripheral surface of the drum 1, with preset timing, with the beam L of laser light which it outputs while modulating the beam L in response to image formation signals for the formation of each of the four monochromatic images which are different in color. Thus, an electrostatic latent image which reflects the image signals for the formation of a monochromatic image of one of the primary colors, is formed on the peripheral surface of the drum 1 in each cartridge 50. Then, the electrostatic latent image in each cartridge 50 is developed by the developing apparatus 4 into an image formed of developer (which hereafter may be referred to as developer image or toner image). In other words, developer images of y, m, c and k colors, which correspond to the four primary colors into which the full-color image to be formed was separated, are formed on the drums 1 in the cartridges 50*y*, 50*m*, 50*c* and 50*k*, respectively, with preset control timing. Then, the developer image in each cartridge 50 is electrostatically transferred (first transfer) onto the belt 5*a*, which is being circularly moved, in the corresponding transfer nip T1. In other words, the four monochromatic developer images, different in color, are sequentially transferred in layers onto the belt 5*a*. Thus, an unfixed full-color developer image is effected of the four monochromatic developer images of y, m, c and k colors, one for one, on the belt 5*a*. The transfer residual toner, that is, the toner remaining on the peripheral surface of the drum 1 in each cartridge 50 after the transfer (first transfer) of the developer image onto the belt 5*a* is removed by the apparatus 6. Then, the portion of the peripheral surface of the drum 1, from which the transfer residual toner has been removed, is used again for image formation.

Meanwhile, a feed roller 11 begins to be driven with preset control timing, whereby one of the recording sheets P in the cassette 10 is fed into the apparatus main assembly 100A while being separated from the rest. Then, the recording sheet P is conveyed upward through a vertical recording sheet conveyance passage Z, which is in the front portion of the apparatus main assembly 100A. Then, the recording sheet P is introduced into, and conveyed through, the transfer nip T2 (for second transfer). While the recording sheet P is conveyed through the second transfer nip T2, the layered four monochromatic developer images, different in color, on the belt 5*a* are electrostatically transferred together (second transfer) onto the recording sheet P, starting from the leading edge of the full-color image. Then, the recording sheet P is separated from the belt 5*a*, introduced into the apparatus 12, and subjected to heat and pressure in the fixation nip of the apparatus 12. Thus, the layered four monochromatic images, different in color, on the recording sheet P are mixed, and fixed to the recording sheet P. Then, the recording sheet P is discharged as a full-color copy of the original, into the tray 14 through the recording sheet outlet 13 of the apparatus 12. The toner remaining on the surface of the belt 5*a* after the separation of the recording sheet P from the belt 5*a* is electrostatically adhered to the peripheral surface of the drum 1 of the first cartridge 50*y*, for example, in the corresponding first transfer nip T1, and is removed by the apparatus 6 of the first cartridge 50*y*.

(Method for Replacing Cartridges)

As each cartridge 50 is used for image formation, the developer t in the developer container 4*c* of the cartridge 50 is consumed. Eventually, the developer t in the container 4*c* is consumed to such an extent that it becomes impossible for the cartridge 50 to form images satisfactory to the user who purchased the cartridge 50. At this point, the cartridge 50 loses its commercial value as a cartridge. Thus, a cartridge 50 is provided with a means for detecting the remaining amount of developer in the cartridge 50. The remaining amount of developer in the cartridge is compared by the control circuit 200 of the apparatus main assembly 100A, with the threshold value set for informing a user of the predicted remaining amount of service life of the cartridge and/or warning the user of the imminent ending of the service life of the cartridge. If it is determined by the control circuit portion 200 that any of the cartridges 50 is no more in the residual amount of developer therein than the preset threshold value, a warning regarding the residual service life of the cartridge is outputted on a display (unshown), suggesting thereby the user to prepare a replacement cartridge for the cartridge, or to replace the cartridge, in order to prevent the image forming apparatus from falling below a preset level in terms of image quality. The procedure to be carried out by the user of the apparatus 100 in this embodiment to replace a cartridge or cartridges in the apparatus main assembly 100A is as follows. In order to make it easier for a user to replace the cartridge(s) in the image forming apparatus 100 in this embodiment, the apparatus 100 is structured so that the cartridges are mounted in the cartridge drawer 60 (cartridge supporting member or cartridge tray, which hereafter will be referred to simply as tray 60) of the apparatus main assembly 100A), which can be pulled out of the apparatus main assembly 100A virtually in entirety in the frontward direction. Therefore, the used is allowed to replace the cartridge(s) 50 from the front side of the apparatus main assembly 100A (so-called front access).

Figure 3A:
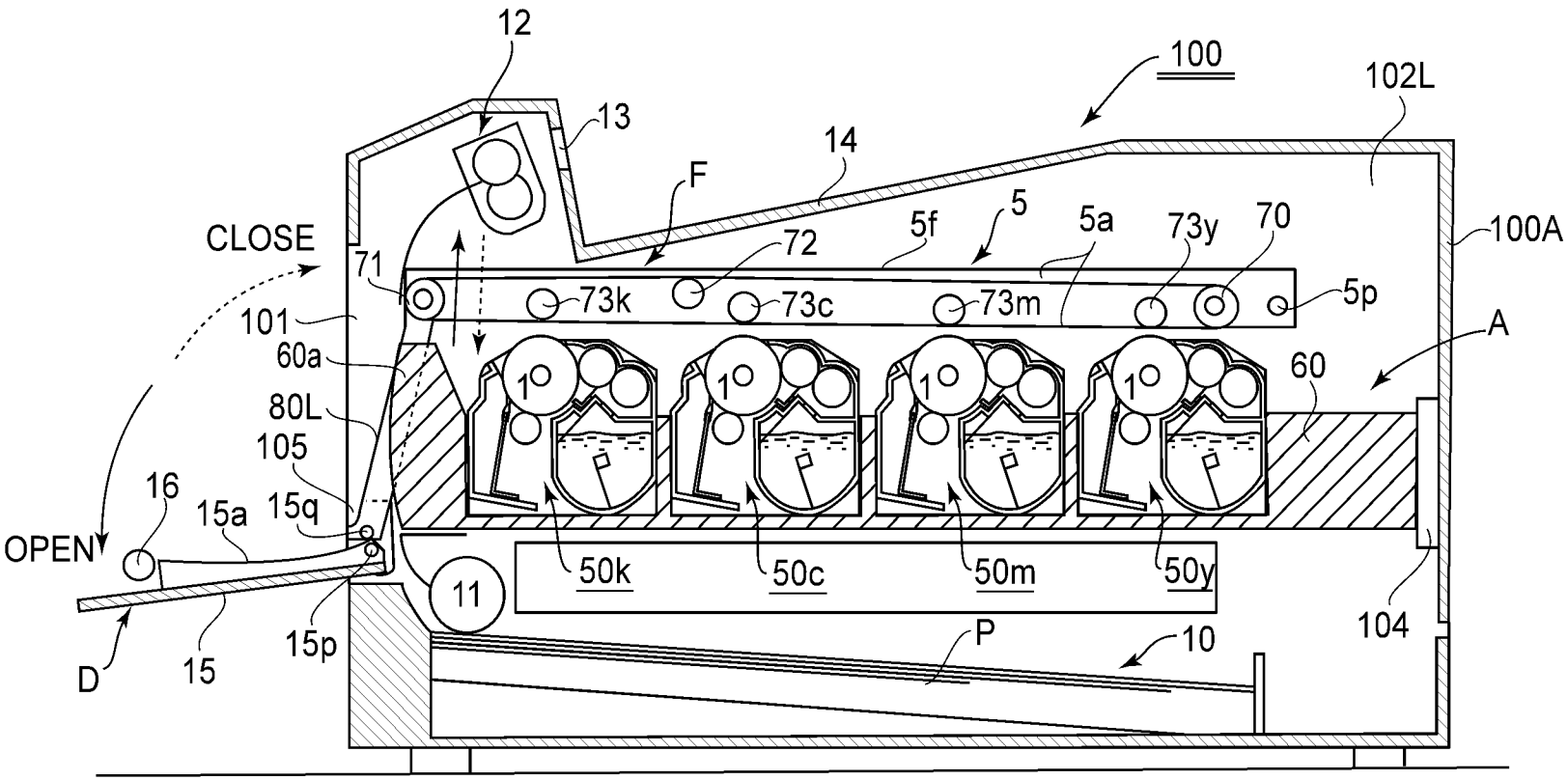
FIGS. 3A and 3B are vertical sectional views of the electrophotographic image forming apparatus in the first preferred embodiment of the present invention, as seen from the right side of the apparatus when the door of the main assembly of the image forming apparatus is in its open position.
Figure 3B:
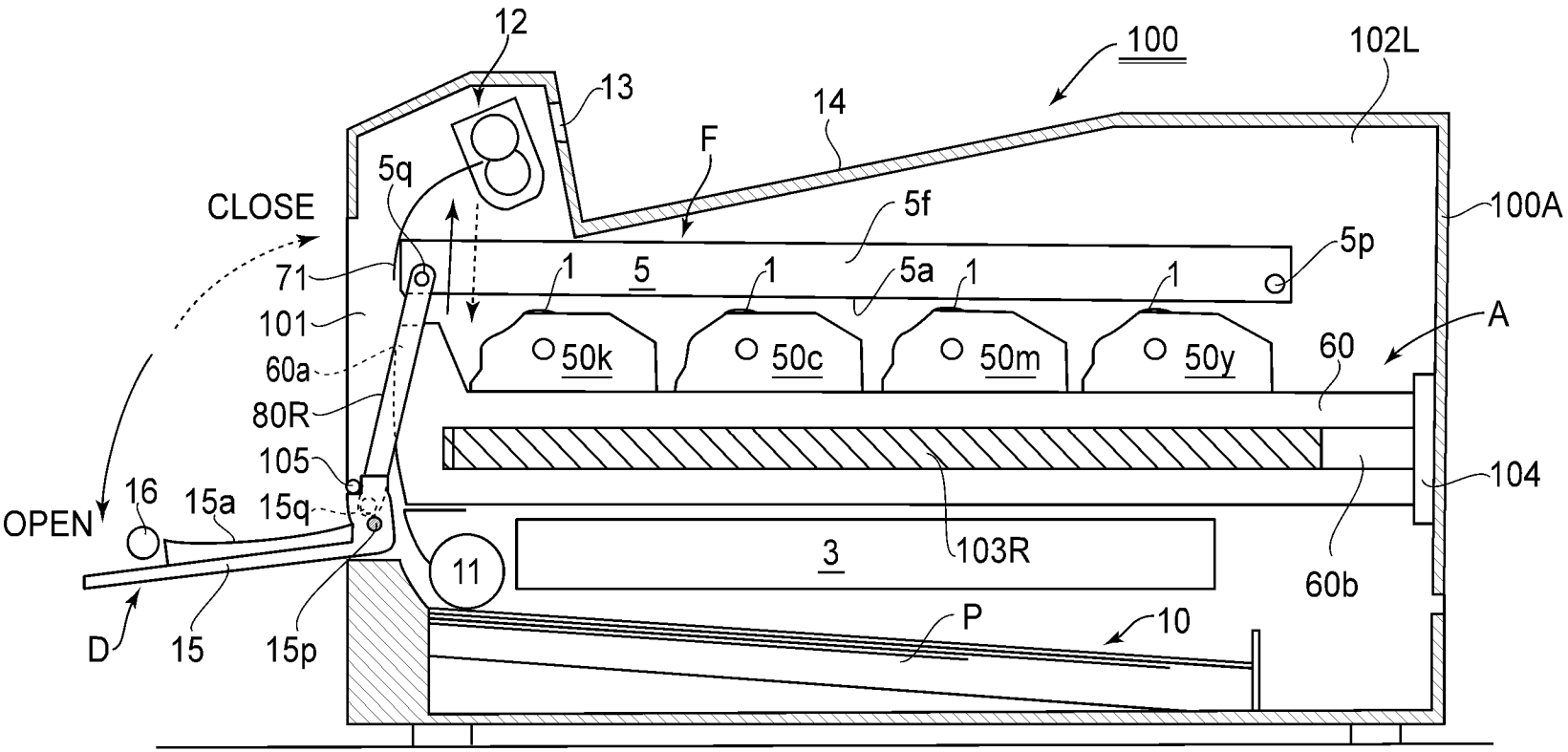

The front wall of the apparatus main assembly 100A is provided with an opening 101, through which the cartridges 50 are put through to be inserted into, or removed from, the apparatus main assembly 100A. The front wall of the apparatus main assembly 100A is also provided with a door 15, which can be rotationally moved between its closed position and open position. When the door 15 is in the closed position, it keeps the opening 101 covered, whereas when it is in the open position, it keeps the opening 101 exposed. Referring to FIGS. 1B, 3A and 3B, the door 15 is rotationally movable relative to the apparatus main assembly 100A about the horizontal shaft 15*p* (hinge shaft: second rotation axle), which is at the bottom edge of the door 15. Thus, when the door 15 is in its open position, it can be rotationally moved upward about the shaft 15*p* so that it is moved into its closed position C in which it keeps the opening 101 of the apparatus main assembly 100A covered as shown in FIGS. 1A and 1B. That is, as the door 15 is closed, the opening 101 is covered by the door 15. Further, when the door 15 is in its closed position, it can be rotationally moved frontward of the apparatus main assembly 100A about the shaft 15*p*, into its open position D, as shown in FIGS. 3A and 3B. That is, as the door 15 is opened, the opening 101 becomes exposed. The door 15 is provided with a pair of recording medium guiding ribs 15*a*, which are on the inward surface of the door 15 and are the parts of the above-mentioned vertical recording sheet passage Z. Further, the above-mentioned second transfer roller 16 also is attached to the inward side of the door 15. Thus, as the door 15 is opened or closed, the second transfer roller 16 moves out of, or into, the apparatus main assembly 100A, respectively.

Figure 4A:
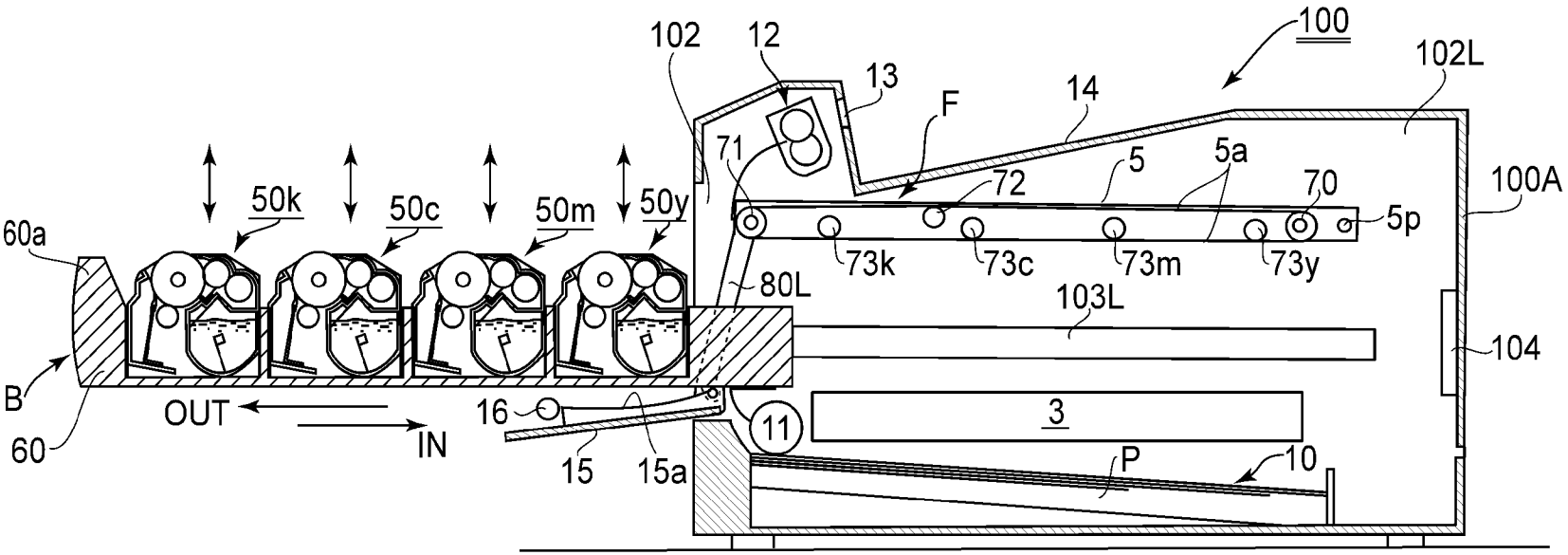
FIGS. 4A and 4B are vertical sectional views of the electrophotographic image forming apparatus in the first preferred embodiment of the present invention, as seen from the right side of the apparatus when the door of the main assembly of the image forming apparatus is in its outermost position.
Figure 4B:
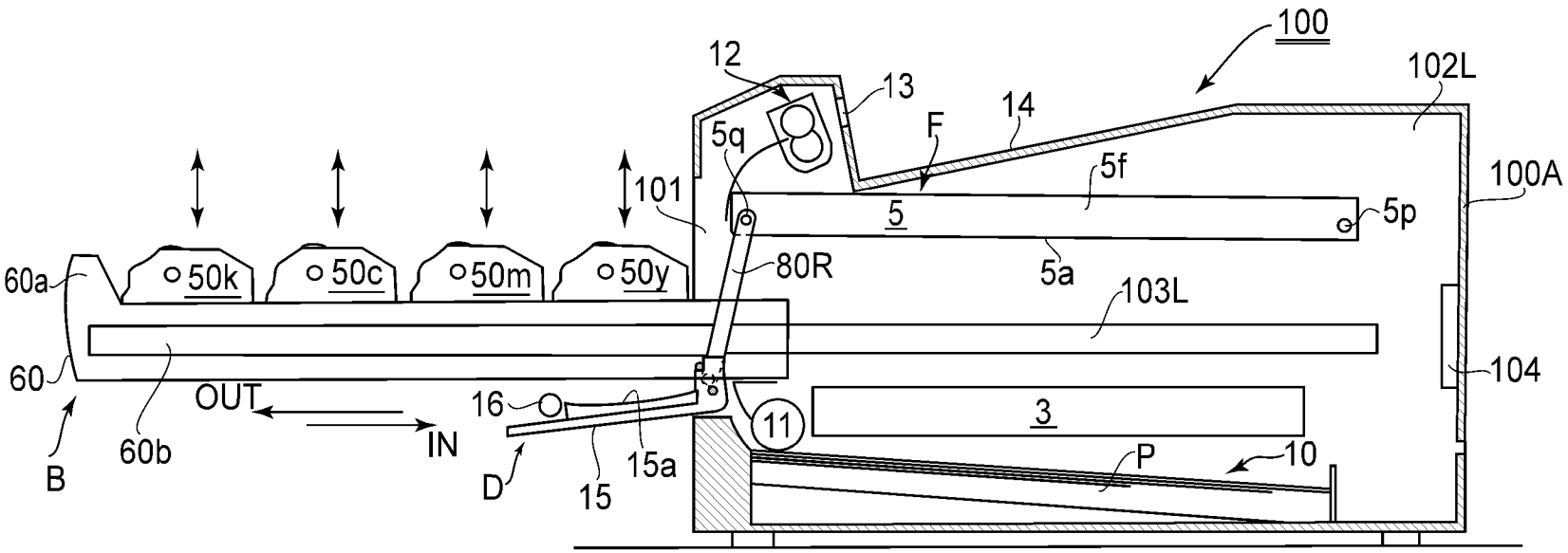

The tray 60 is roughly in the form of a rectangular box, and its lengthwise direction is parallel to the front-to-rear direction of the apparatus 100. It is provided with a pair of long and narrow portions 60*b* (by which tray 60 is guided), which are parts the left and right walls (long walls) of the tray 60, one for one and extend in the front-to-rear direction. The pair of tray guiding portions 60*b* are symmetrically positioned with reference to the centerline of the tray 60 in terms of the widthwise direction of the tray 60. Correspondingly, the left and right walls of the main frame of the main assembly 100A are provided with the pair of tray guiding portions 103 (103L and 103R), which are on the inward side of the walls, one for one. The pair of the tray guiding portions 103 extend in the front-to-rear direction, and are symmetrically positioned with reference to the centerline between the two guiding portions 103L and 103R in terms of the widthwise direction of the apparatus main assembly 100A. The above described pair of tray guiding portions 60*b* and the pair of tray guiding portions 103 engage with each other. The tray guiding portions 60*b* are in the form of a groove, whereas the tray guiding portions 101 are in the form of a rib, which fits in the tray guiding portion 60*b*. Thus, the tray 60 is held between the left and right walls L and R, respectively, of the main frame of the apparatus main assembly 100A by the engagement between the pair of tray guiding portions 60*b* and the pair of tray guiding portions 102, being thereby enabled to roughly horizontally slide in the front-to-rear (rear-to-front) direction. Thus, when the door 15 is open as shown in FIGS. 3A and 3B, the tray 60 is movable through the opening 101, between its innermost position A, which is inside the apparatus main assembly 100A, and its outermost position, which is outside the apparatus main assembly 100A as shown in FIGS. 4A and 4B.

The tray 60 is capable of holding multiple (four in this embodiment) cartridges 50 (50*y*, 50*m*, 50*c* and 50*k*) in such a manner that the cartridges align in parallel, in the direction parallel to the moving direction of the tray 60. More specifically, the tray 60 has four cartridge chambers (cartridge holding portions) created by partitioning the internal space of the tray 60 with partitioning walls, in the front-to-rear direction, to hold the four cartridges 50 (50*y*, 50*m*, 50*c* and 50*k*) one for one. Each cartridge 50 is supported by the tray 60 in such a manner that the lengthwise direction (axial line of drum 1) of the cartridge 50 in one of the above-mentioned cartridge holding portions becomes parallel to the left-and-right direction. The tray 60 is linearly movable in the direction perpendicular to the lengthwise direction of the cartridge 50 in the tray 60. The innermost position A of the tray 60 is where the tray 60 keeps the cartridge 50 positioned for image formation, whereas the outermost position B of the tray 60 is where the tray 60 allows the cartridge 50 to be moved into, or out of, the tray 60 by a user.

When the door 15 is in its closed position C as shown in FIG. 1, the tray 60 is kept stationary in its preset innermost position A in the apparatus main assembly 100A by a tray positioning-and-holding means (unshown). Further, each of the cartridges 50 in the tray 60 is kept immovable in its image forming position by a cartridge positioning-and-holding means (unshown), and the driving force input portion of each cartridge 50 (unshown coupling) is in engagement with the driving force output portion (unshown cartridge drive coupling) of the apparatus main assembly 100A, making it possible for the driving force from the cartridge driving motor (unshown) of the apparatus main assembly 100A to be transmitted to the cartridge 50. Further, the electric power input portion of each cartridge 50 is electrically in contact with the electric power output portion of the apparatus main assembly 100A, making it possible for the preset biases (charge bias, development bias, etc.) to be applied to each cartridge 50 from the electric power source (unshown) of the apparatus main assembly 100A. Further, the transfer unit 5 is kept in its contact position E (transfer-possible position) in which it keeps the belt 5*a* in contact with the top portion of the peripheral surface of the drum 1 in each cartridge 50. It is when the apparatus 100 is in the above described state that the apparatus 100 is ready for image formation.

As the door 15 is opened, that is, as the door 15 is moved from its closed position C shown in FIGS. 3A and 3B to its open position D shown in FIGS. 3A and 3B, the unit 5 is swung about the shaft 5*p* by the movement of a pair of linkage arms 80 (80L and 80R) which are moved by the movement of the door 15, as will be described later. Thus, the unit 5 is moved from the above-mentioned contact position E to the separation position F in which the unit 5 keeps the belt 5*a* separated from the top portion of the peripheral surface of the drum 1 in each cartridge 50. Further, the driving force input portion and electric power input portion of each cartridge 50 are disengaged from the driving force output portion and electric power output portion of the apparatus main assembly 100A, respectively. Then, a user is to grasp the handle 60*a* on the front wall of the tray 60 through the exposed opening 101, and pull the handle 60*a* to move the tray 60 out of the apparatus main assembly 100A through the opening 101 until the tray 60 is stopped by a stopper (unshown), that is, until the tray 60 which was in the innermost position A in the apparatus main assembly 100A, shown in FIGS. 3A and 3B, is moved to the outermost position B which is outside the apparatus main assembly 100A, shown in FIGS. 4A and 4B. With the tray 60 being virtually entirely out of the apparatus main assembly 100A, all the cartridge 50 in the tray 60 are out of the apparatus main assembly 100A, being thereby fully exposed upward.

While the tray 60 is pulled out of the apparatus main assembly 100A, the unit 5 is its separation position F, and therefore, there is a gap between the belt 5*a* and the top portion of the peripheral surface of each drum 1. Therefore, the drums 1 and belt 5*a* do not rub against each other. Further, even after the tray 60 is horizontally pulled out of the apparatus main assembly 100A, to the outermost position B, it is kept stable in attitude by the engagement between the pair of tray guiding portions 60*a* of the tray 60, and the pair of tray guiding portions 101 of the apparatus main assembly 100A. When the tray 60 is in the outermost position B, each cartridge 50 in the tray 60 is being supported by the tray 60 in such a manner than it can be upwardly removed from the tray 60. Incidentally, each cartridge 50 can be supported by the tray 60 by being vertically lowered into the tray 60. The tray 60 supports each cartridge 50, in one of its cartridge chambers, with the presence of a small amount of play between the cartridge 50 and the walls of the corresponding cartridge chamber. Because of this structural arrangement, the cartridges 50 in the tray 60 can be easily replaced.

In the case of the apparatus 100 in this embodiment, the cartridge order in the tray 60 in terms of the direction in which the tray 60 is moved from the innermost position A to the outermost position B is such that the cartridge 50*y* is positioned most upstream; the second is the cartridge 50*m*; the third is the cartridge 50*c*; and the cartridge 50*k* is positioned most downstream. That is, the four cartridges 50*y*, 50*m*, 50*c* and 50*k* which contain the developers of y, m, c and k colors, respectively, are supported in the listed order. In other words, among the multiple (four) cartridges 50, the cartridge 50*k*, that is, the cartridge which contains the black developer is supported most downstream in terms of the direction in which the tray 60 is moved from the innermost position A to the outermost position B. The cartridge 50*k* is substantially greater in developer consumption than the other cartridges 50*y*, 50*m* and 50*k*. Thus, it is highest in replacement frequency. In other words, the cartridge 50*k* is supported by the tray 60 so that the cartridge 50*k* is the frontmost cartridge in the apparatus main assembly 100A (tray 60). Therefore, when it is only the cartridge 50*k* that is necessary to be replaced among all the cartridges 50 in the apparatus main assembly 100A, the tray 60 has to be pulled out of the apparatus main assembly 100A only by a short distance, that is, a distance large enough for only the cartridge 50*k* to be exposed from the apparatus main assembly 100A. In other words, when only the cartridge 50*k* has to be replaced, the tray 60 does not need to be pulled out of the apparatus main assembly 100A far enough to be stopped by the stopper. That is, this arrangement improved the apparatus 100 in the efficiency with which the cartridge 50*k* can be replaced. That is, when the cartridge 50*k*, which is the most downstream cartridge in terms of the direction in which the tray 60 is pulled out of the apparatus main assembly 100A, is only one that needs to be mounted into, or moved out of, the tray 60, the tray 60 does not need to be in the outermost position B. Even in the case such as this, the tray 60 has to be on the outward side of the position in which the tray 60 has to be for image formation, and therefore, the cartridge 50*k* is on the front side of its image formation position, more specifically, on the front side of the front wall of the apparatus main assembly 100A, making it easier for a user to replace the cartridge 50*k*. To sum up, the tray 60 supports the multiple (four) cartridges 50 in such a manner that as the tray 60 is moved from the innermost position A to the outermost position B, the cartridges 50 can be sequentially removed from the tray 60, starting from the most downstream one in terms of the moving direction of the tray 60, and also, that as the tray 60 reaches the outermost position B, all of the multiple cartridges 50 can be removed from the tray 60. Further, the tray 60 is horizontally movable, and supports the cartridges 50 in such a manner that when the tray 60 is in the outermost position B, the cartridges 50 can be vertically removed upward from the tray 60, or mounted into the tray 60 by being vertically lowered into the tray 60.

After the tray 60 is pulled out to the outermost position B, and all the cartridges to be replaced are replaced, the tray 60 is to be pushed back into the apparatus main assembly 100A until it reaches the innermost position A (FIG. 4A→FIG. 4B). As the tray 60 is pushed almost all the way into the apparatus main assembly 100A, the trailing end portion of the tray 60 is caught by the cartridge catching portion 104 (stopper) of the apparatus main assembly 100A, being thereby prevented from being pushed further into the apparatus main assembly 100A. While the tray 60 is pushed into the apparatus main assembly 100A, the unit 5 remains held in its separation position F, and therefore, the belt 5*a* remains separated from the top portion of the peripheral surface of the drum 1 in each cartridge 50, being thereby prevented from rubbing against the drums 1. Then, the door 15 is to be closed (FIG. 2→FIG. 1A). As the door 15 is closed, the tray 60 is moved into its preset innermost position A by the tray positioning-and-holding means (unshown) and the movement of the door 15, and is kept in the innermost position by the tray positioning-and-holding means. Further, each cartridge 50 in the tray 60 also is moved into its image formation position by the cartridge positioning-and-holding means (unshown), and remains held in the image formation position by the cartridge positioning-and-holding means. As each cartridge 50 is moved into the image formation position, the driving force input portion (unshown) of the cartridge 50 engages with the driving force output portion (unshown) of the apparatus main assembly 100A. Further, the electric power input portion (unshown) of each cartridge is electrically engaged with the electric power output portion (unshown) of the apparatus main assembly 100A. Further, the transfer unit 5 is rotationally moved downward about the shaft 5*p* by the movement of the pair of linkage arms 80 (80L and 80R), from its separation position F. Thus, the unit 5 is moved into its contact position E, causing the belt 5*a* to come into contact with the top portion of the peripheral surface of each cartridge P in a preset manner. Then, the unit 5 is kept in the contact position E, readying again the apparatus 100 for image formation.

(Linkage Between Door 15 and Transfer Unit 5)

Figure 5:
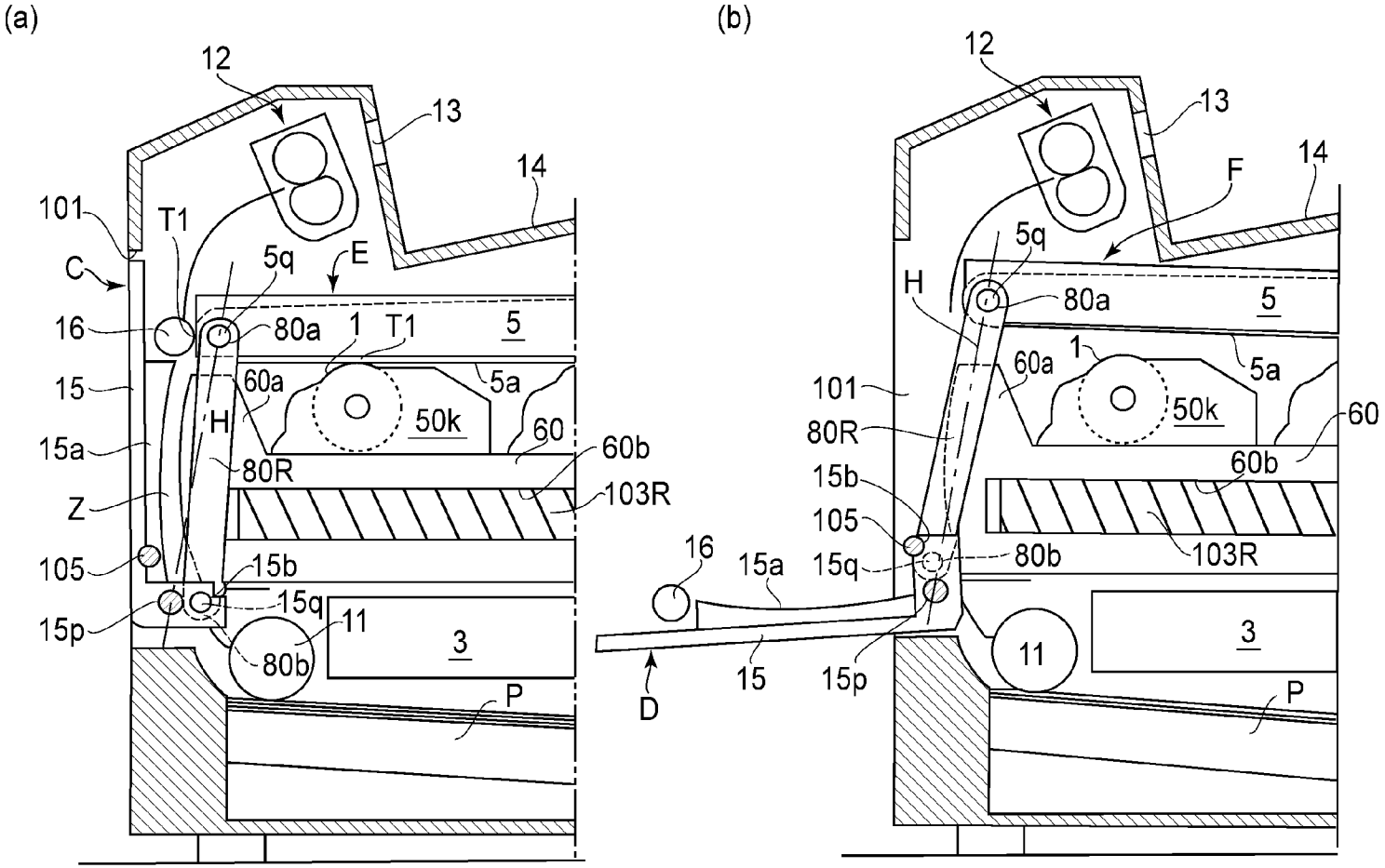
FIGS. 5(*a*) and 5(*b*) are enlarged vertical sectional views of a part of FIG. 1A and a part of FIG. 1B, respectively.

FIG. 5(*a*) is an enlarged view of a part of the FIG. 1B, and FIG. 5(*b*) is an enlarged view of a part of FIG. 1B. The transfer unit 5 is above the space for the tray 60 and the cartridges 50 therein. It is attached to the apparatus main assembly 100A by its rear end portion. More specifically, the rear end portion of the unit 5 is supported by the transfer unit supporting shaft 5*p*, which is attached to the left wall 102 L and right wall 102R (unshown) of the main frame of the apparatus main assembly 100A so that the unit 5 is rotationally movable upward or downward about the shaft 5*p*. The unit 5 is provided with a pair of first projections 5*q* (first connectors), which are on the front portion of the left wall of the transfer frame 5*f* and the front portion of the right wall of the transfer frame 5*f*, one for one. The pair of first projections 5*q* are symmetrically positioned to each other with reference to the centerline of the unit 5 in terms of the left-and-right direction. Correspondingly, the door 15 is provided with a pair of second projections 15*q* (second connectors), which are on the left and right end of the bottom edge portion of the door 15, one for one, being next to the horizontal shaft 15*p* (hinge shaft), about which the door 15 is rotationally movable to be opened or closed. The pair of second projections 15*q* are symmetrically positioned to each other with reference to the center line of the door 15 in terms of the left-and-right direction. Further, the left and right ends of the unit 5 are connected to the left and right ends, respectively, of the door 15 with the pair of linkage arms 80 (80L and 80R). More concretely, the pair of first projections 5*q* are in the pair of first holes 80*a* of the top end portion of the linkage arms 80, one for one, whereas the pair of second projections 5*q* are in a pair of second holes 80*b* of the bottom end portions of the linkage arm 80, one for one. Thus, the linkages arms 80 are allowed to rotate about the pair of projections 5*q* and 15*q* while remaining in engagement with the unit 5 and door 15.

That is, the left and right linkage arms 80 (80L and 80R) are the members which are in connection to the unit 5 and door 15 and cause the unit 5 to be moved by the movement of the door 15. Referring to FIG. 5(*a*), when the door 15 is in its closed position C, and the transfer unit 5 is in its contact position E, each second projection 15*q* is at roughly the same level as the shaft 15*q*, and is on the inward side of the shaft 15*p* in the apparatus main assembly 100A. Thus, as the door 15 is moved from the closed position C to the open position D, the second projection 15*q* moves upward while lifting linkage arm 80. Thus, the unit 5 is rotationally moved upward about the shaft 5*p*. That is, the unit 5 is moved upward from its contact position E. Then, as the door 15 is opened further, the second projection 15*q* is positioned above the shaft 15*p* by the movement of the door 15. Eventually, the second projection 15*q* is moved past a hypothetical line H which connects the center (axial line) of the first projection 5*q* and the center (axial line) of the shaft 15*p*, and then, toward the opening 101. Then, as the point 15*b* of contact of the door 15 is caught by the stationary point 105 of contact 105 (door stopper) of the apparatus main assembly 100A, the door 15 is prevented by the door stopper 105 from opening further, and remains in its open position D. During the opening of the door 15, the unit 5 is lifted by the linkage arms 80 from its contact position E to its separation position F. Thus, by the time when the door 15 will be in its open position D, the second projection 15*q* will be on the door side (upstream side in terms of cartridge mounting direction) of the above-described hypothetical line H. Therefore, when the door 15 is in its open position D, the weight of the door 15 works in the direction to cause the door 15 to rotationally move about the shaft 15*p* in the direction in which the door 15 is opened, that is, the direction to keep the point 15*b* of contact of the door 15 pressed upon the point 105 of contact of the apparatus main assembly 100A. Thus, the door 15 remains stable in its open position D, which in turn keeps the unit 5 stable in its separation position F (FIG. 5(*b*)).

As the door 15 is closed, that is, as the door 15 is moved from its open position D to its closed position C, the point of contact 15*b* of the door 15 separates from the point of contact 105 of the apparatus main assembly 100A, and the second projection 15*q* moves inward of the apparatus main assembly 100A, beyond the hypothetical line H, that is, in the opposite direction (downstream in terms of cartridge mounting direction) from the opening 101. Then, as the door 15 is closed further, the movement of the door 15 lowers the second projection 15*q* from its position above the shaft 15*p* to the position which is slightly lower than the position of the shaft 15*p*, moving thereby the linkage arm 80 downward. Thus, the unit 5 is rotationally moved downward about the transfer unit supporting shaft 5*p* by the downward movement of the linkage shaft 80. That is, the unit 5 is moved downward from its separation position F. Toward the end of the closing movement of the door 15 into its closed position C, the transfer unit 5 descends into the contact position E, and therefore, the second projection 15*q* descends so that it will be at roughly same level as the shaft 15*p* and will be inward of the shaft 15*p* in the apparatus main assembly 100A. When the door 15 is in its closed position C, the second projection 15*q* is on the opposite side of the theoretical line H from the opening 101. Therefore, the weight of the unit 5 works in the direction to rotationally move the door 15 in the closing direction about the shaft 15*p*. Thus, the door 15 is kept stable in its closed position C, which in turn keeps the unit stable in its contact position E (FIG. 5(*a*)).

In this embodiment, the linkage arm 80 is the member which connects the door 15 with the unit 5 and causes the unit 5 to be moved by the movement of the door 15. That is, as the door 15 is moved from its closed position C to its open position D, the linkage arm 80 causes the unit 5 from its contact position E to its separation position F (FIG. 5(*a*) →FIG. 5(*b*)). Further, as the door 15 is moved from the open position D to the closed position C, the linkage arm 80 causes the unit 5 from the separation position F to the contact position E (FIG. 5(*b*)→FIG. 5(*a*)).

In other words, the image forming apparatus 100 is structured so that the transfer unit 5, which has to be in contact with the cartridges 50 in order for the apparatus 100 to form images is moved from the contact position E in which the unit 5 is in contact with the cartridges 50, to the separation position F in which it remains separated from the cartridges 50, or from the separation position F to the contact position E, by the opening and closing movement of the door 15, as described above. Therefore, the components, mechanisms, and the like, which are dedicated to the operation for vertically moving the tray 60 to prevent the problem that when the tray 60 is moved from its innermost position A to its outermost position B, and vice versa, the tray 60 and/or the cartridges 50 in the tray 60 contact, interfere with, and/or rub against the components, mechanisms, etc., of the apparatus main assembly 100A, are unnecessary. That is, the image forming apparatus 100 does not require its user to vertically move the tray 60, which is relatively heavy because of the weight of the cartridges 50 it is holding. Therefore, it is superior to any of the image forming apparatuses in accordance with the prior arts, in terms of the operational efficiency of the tray 60. Moreover, the tray guiding members 108 (103L and 103R) of the tray 60 do not need to be movable. Therefore, the guiding members 103 may be formed as integral parts of the side walls 102 (102L and 102R) of the main frame of the apparatus main assembly 100A to provide an image forming apparatus which is simpler in structure and lighter than any of the image forming apparatuses in accordance with the prior arts.

Further, the tray supporting shaft 5*p*, about which the transfer unit 5 is rotationally movable, is on the downstream side of the drum 1 of the cartridge 50*y*, which is the most downstream cartridge in the cartridge drawer 60 (tray 60) in terms of the direction (indicated by arrow mark IN in FIGS. 4A and 4B) in which the cartridge drawer 60 (tray 60) is moved back into the apparatus main assembly 100A. Therefore, as the transfer unit 5 is rotationally moved about the shaft 5*p* by the opening movement of the door 15, the drums 1 in all the cartridges 50 in the cartridge drawer 60 are prevented from coming into contact with the intermediary transfer belt 5*a* when the cartridge drawer 60 is put back into the apparatus main assembly 100A. Thus, it is possible to minimize the space necessary for moving the transfer unit 5 in order to put the cartridge drawer 60 back into the apparatus main assembly 100A, making it thereby possible to reduce the image forming apparatus 100 in size.

[Miscellaneous Embodiments]

(1) In the first embodiment, the tray 60 was linearly movable in the direction parallel to the surface G on which the apparatus main assembly 100A is placed. However, the direction in which the tray 60 is moved does not need to limited to the direction in the first embodiment. That is, the present invention is also compatible with an image forming apparatus structured so that the tray 60 is linearly movable at an angle relative to the surface G on which the apparatus main assembly 100A is placed.

(2) The present invention is compatible with an image forming apparatus structured so that the tray 60 is removable from the apparatus main assembly 100A by disengaging the stopper from the tray 60.

(3) In the first embodiment, the "cartridge mounting-and-dismounting position" is where the tray 60 is when the cartridge(s) 50 are mounted into, or removed from, the tray 60. In terms of the direction in which the tray 60 is pulled out of the apparatus main assembly 100A, the "cartridge mounting-and-dismounting position" is on the downstream side of the image formation position A of each cartridge 50. Further, the "cartridge mounting-and-dismounting position" is such a position that enables a user to remove the cartridge(s) 50 in the tray 60, or mounting the cartridge(s) 50 into the tray 60, without intruding into the apparatus main assembly 100A. In other words, when the tray 60 is in the "cartridge mounting-and-dismounting position", the tray 60 does not need to be entirely outside the apparatus main assembly 100A.

(4) In the first embodiment, the number of the cartridges 50 supportable by the tray 60 was four. However, it does not need to be four. That is, the present invention is also compatible with a tray 60 which can hold only a single cartridge 50, only two cartridges 50, only three cartridges 50, or five or more cartridges 50, as well as the tray 60 which holds only four cartridges 50. Also in the first embodiment, the image forming apparatus was an electrophotographic color image forming apparatus. However, the present invention is also compatible with an electrophotographic monochromatic image forming apparatus which employs only a single cartridge.

(5) The transfer unit 5 of the image forming apparatus in the first embodiment may be replaced with an apparatus which conveys the recording sheet P in such a manner that developer images are directly transferred onto the recording sheet P from the drums 1. That is, the transfer unit 5 may be a transfer apparatus which comprises a recording medium conveyance belt (as recording medium conveying means) which conveys the recording sheet P to transfer the developer images formed on the drums 1, directly onto the recording sheet P.

(6) In the first embodiment, the cartridges 50 supported by the tray 60 were of the so-called integration type. However, the present invention is also compatible with an image forming apparatus which employs a pair or pairs of a process cartridge of the so-called separation type and a development cartridge, and which is structured so that at least the development cartridge(s) are removably supported by the tray 60. Incidentally, the process cartridge of the separation type is such a cartridge that has the drum 1 and the processing means 2 and 6, that is, the processing means other than the developing means 4. The development cartridge is such a developing means that has a developer storage portion which stores the developer to be used for developing a latent image formed on the drum 1, and the development roller which is a developer bearing member for supplying the drum with the developer.

According to the present invention, in terms of the direction in which the cartridge drawer is put back into the apparatus main assembly, the rotational axis of the transfer unit is on the downstream side of the electrophotographic photosensitive drum. Therefore, it can minimize the space which an image forming apparatus requires to move its transfer unit, making it thereby possible to provide an image forming apparatus which is substantially smaller in size than any of the image forming apparatuses in accordance with the prior arts.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 281426/2009 and 253575/2010 filed Dec. 11, 2009 and Nov. 12, 2010, respectively, which are hereby incorporated by reference.

What is claimed is:

1. An electrophotographic image forming apparatus for forming an image on a recording material, comprising:

an opening provided in a main assembly of the apparatus;

an openable member movable between a close position for closing said opening and an open position for opening said opening;

a drawer member for supporting an electrophotographic photosensitive member, said drawer member being movable in a direction crossing with a longitudinal direction of said electrophotographic photosensitive member through said opening between an inside position inside said main assembly of the apparatus and an outside position outside said main assembly of the apparatus where a cartridge can be mounted and dismounted;

a transfer unit movable about a rotation axis disposed downstream of said electrophotographic photosensitive member with respect to a mounting direction of said drawer member from the outside position to the inside position, between a contact position in contact with said electrophotographic photosensitive member and a separation position separate from said electrophotographic photosensitive member in a state that said drawer member is in the inside position, wherein said transfer unit is disposed above said drawer member; and an interrelating member interrelating said openable member and said transfer unit with each other, wherein said interrelating member moves said transfer unit from the contact position to the separation position with movement of said openable member from the close position to the open position, and moves said transfer unit from the separation position to the contact position with movement of said openable member from the open position to the close position.

2. An apparatus according to claim 1, wherein said cartridge is a process cartridge containing said electrophotographic photosensitive member and developing means for developing an electrostatic latent image formed on said electrophotographic photosensitive member.

3. An apparatus according to claim 1, wherein said cartridge is a separable type process cartridge containing said electrophotographic photosensitive member and image forming process means other than developing means for developing an electrostatic latent image formed on said electrophotographic photosensitive member, or a developing cartridge containing said developing means and a developer accommodating portion accommodating a developer to be used for developing the electrostatic latent image.

4. An apparatus according to claim 1, wherein said cartridge is a developing cartridge including developing means for developing an electrostatic latent image formed on said electrophotographic photosensitive member and a developer accommodating portion accommodating a developer to be used for developing the electrostatic latent image.

5. An apparatus according to claim 1, wherein said transfer unit includes an intermediary transfer member for receiving a developed image formed on said electrophotographic photosensitive member and for transferring the received developed image onto the recording material.

6. An apparatus according to claim 1, wherein said transfer unit includes a recording material feeding member for feeding the recording material to transfer the developed image formed on said electrophotographic photosensitive member directly onto the recording material.

7. An apparatus according to claim 1, wherein said drawer member is capable of supporting a plurality of cartridges at positions along the mounting direction, and wherein the rotation axis is downstream of said electrophotographic photosensitive member contained in one of said plurality of cartridges disposed most downstream with respect to the mounting direction.

8. An apparatus according to claim 7, wherein a cartridge accommodating a black color developer of said plurality of cartridges is disposed upstreammost position with respect to the mounting direction.

9. An apparatus according to claim 7, wherein when said drawer member supporting said plurality of cartridges moves from the inside position to the outside position causes said plurality of cartridges removable from said drawer member in the order from the upstream side with respect to the mounting direction, and all of said plurality of cartridges are removable when said drawer member takes the outside position.

10. An apparatus according to claim 7, wherein said drawer member supports said plurality of cartridges so that said cartridges are removable upwardly, when said drawer member takes the outside position.

11. An apparatus according to claim 1, wherein said drawer member is linearly movable horizontally, diagonally upwardly or diagonally downwardly.

12. An electrophotographic image forming apparatus for forming an image on a recording material, comprising:

an opening provided in a main assembly of the apparatus;

an openable member movable between a close position for closing said opening and an open position for opening said opening;

a drawer member for supporting an electrophotographic photosensitive member, said drawer member being movable in a direction crossing with a longitudinal direction of said electrophotographic photosensitive member through said opening between an inside position inside said main assembly of the apparatus and an outside position outside said main assembly of the apparatus where a cartridge can be mounted and dismounted;

a transfer unit movable about a rotation axis disposed downstream of said electrophotographic photosensitive member with respect to a mounting direction of said drawer member from the outside position to the inside position, between a contact position in contact with said electrophotographic photosensitive member and a separation position separate from said electrophotographic photosensitive member in a state that said drawer member is in the inside position; and an interrelating member interrelating said openable member and said transfer unit with each other, wherein said interrelating member moves said transfer unit from the contact position to the separation position with movement of said openable member from the close position to the open position, and moves said transfer unit from the separation position to the contact position with movement of said openable member from the open position to the close position, wherein said openable member has a second rotation axis on said main assembly of the apparatus, and said interrelating member includes a first connecting portion rotatably connecting with said transfer unit and a second connecting portion rotatably connecting with said openable member, wherein when said openable member is opened, said second connecting portion is upstream of a line connecting the second rotation axis and the first connecting portion with respect to the mounting direction, and when said openable member is closed, said second connecting portion is downstream of a line connecting said second rotation axis and said first connecting portion with respect to the mounting direction.

13. An apparatus according to claim 12, wherein said cartridge is a process cartridge containing said electrophotographic photosensitive member and developing means for developing an electrostatic latent image formed on said electrophotographic photosensitive member.

14. An apparatus according to claim 12, wherein said cartridge is a separable type process cartridge containing said electrophotographic photosensitive member and image forming process means other than developing means for developing an electrostatic latent image formed on said electrophotographic photosensitive member, or a developing cartridge containing said developing means and a developer accommodating portion accommodating a developer to be used for developing the electrostatic latent image.

15. An apparatus according to claim 12, wherein said cartridge is a developing cartridge including developing means for developing an electrostatic latent image formed on said electrophotographic photosensitive member and a developer accommodating portion and accommodating a developer to be used for developing the electrostatic latent image.

16. An apparatus according to claim 12, wherein said transfer unit includes an intermediary transfer member for receiving a developed image formed on said electrophotographic photosensitive member and for transferring the received developed image onto the recording material.

17. An apparatus according to claim 12, wherein said transfer unit includes a recording material feeding member for feeding the recording material to transfer a developed image formed on said electrophotographic photosensitive member directly onto the recording material.

18. An apparatus according to claim 12, wherein said drawer member is capable of supporting a plurality of cartridges at positions along the mounting direction, and wherein the rotation axis is downstream of said electrophotographic photosensitive member contained in one of said plurality of cartridges disposed most downstream with respect to the mounting direction.

19. An apparatus according to claim 18, wherein a cartridge accommodating a black color developer of said plurality of cartridges is disposed upstreammost position with respect to the mounting direction.

20. An apparatus according to claim 18, wherein when said drawer member supporting said plurality of cartridges moves from the inside position to the outside position causes said plurality of cartridges removable from said drawer member in the order from the upstream side with respect to the mounting direction, and all of said plurality of cartridges are removable when said drawer member takes the outside position.

21. An apparatus according to claim 18, wherein said drawer member supports said plurality of cartridges so that said plurality of cartridges are removable upwardly, when said drawer member takes the outside position.

22. An apparatus according to claim 12, wherein said drawer member is linearly movable horizontally, diagonally upwardly or diagonally downwardly.

* * * * *